US008955287B2

(12) United States Patent
Fortney et al.

(10) Patent No.: US 8,955,287 B2
(45) Date of Patent: Feb. 17, 2015

(54) REPLACEMENT EXPANSION JOINT FOR CEMENT

(76) Inventors: Mike Fortney, Leander, TX (US); Jason Fortney, Leander, TX (US)

( * ) Notice: Subject to any disclaimer, the term of this patent is extended or adjusted under 35 U.S.C. 154(b) by 989 days.

(21) Appl. No.: 11/805,921

(22) Filed: May 25, 2007

(65) Prior Publication Data

US 2008/0115440 A1 May 22, 2008

Related U.S. Application Data

(60) Provisional application No. 60/860,767, filed on Nov. 22, 2006.

(51) Int. Cl.

| | |
|---|---|
| ***E04B 1/00*** | (2006.01) |
| ***E04F 15/14*** | (2006.01) |
| ***E01C 11/10*** | (2006.01) |
| ***E01C 23/02*** | (2006.01) |

(52) U.S. Cl.

CPC ..... *E04F 15/14* (2013.01); *E01C 11/106* (2013.01); *E01C 23/026* (2013.01)

USPC ..... 52/742.1; 52/396.04

(58) Field of Classification Search

USPC ..... 52/393, 396.04, 396.05, 396.06, 741.4, 52/741.41, 742.1, 742.16

See application file for complete search history.

(56) References Cited

U.S. PATENT DOCUMENTS

| | | | | | |
|---|---|---|---|---|---|
| 2,230,688 | A | * | 2/1941 | Irwin | 404/65 |
| 2,695,513 | A | * | 11/1954 | Williams | 52/396.02 |
| 3,180,238 | A | * | 4/1965 | Crone | 404/64 |
| 3,297,294 | A | * | 1/1967 | Middlestadt | 249/9 |
| 3,352,217 | A | * | 11/1967 | Peters et al. | 404/65 |
| 3,388,643 | A | * | 6/1968 | Webb | 404/65 |
| 3,434,401 | A | * | 3/1969 | Kiewit | 404/65 |
| 3,485,149 | A | * | 12/1969 | Boney | 404/64 |
| 3,491,499 | A | * | 1/1970 | Dyer | 52/396.04 |
| 3,521,528 | A | * | 7/1970 | Wangerow | 404/69 |
| 3,604,169 | A | * | 9/1971 | Smith | 52/396.04 |
| 3,645,176 | A | * | 2/1972 | Berchou | 404/64 |
| 3,732,788 | A | * | 5/1973 | Brown | 404/64 |
| 3,775,918 | A | * | 12/1973 | Johnson | 52/155 |
| 3,838,930 | A | * | 10/1974 | Koch | 404/48 |
| 3,871,787 | A | * | 3/1975 | Stegmeier | 404/48 |
| 3,896,597 | A | * | 7/1975 | Deason | 52/396.02 |
| 3,923,411 | A | * | 12/1975 | Berghman | 404/64 |
| 3,960,462 | A | * | 6/1976 | Kerschner | 277/644 |
| 3,967,911 | A | * | 7/1976 | Miers | 404/48 |

(Continued)

*Primary Examiner* — James Ference

(74) *Attorney, Agent, or Firm* — Grady K. Bergen; Griggs Bergen LLP

(57) ABSTRACT

Replacement Expansion Joint for Cement is an expansion joint for use with concrete. The preferred embodiment of the invention utilizes an arrow shaped plastic expansion joint with two holes bored inside the expansion joint. To use the preferred embodiment of Replacement Expansion Joint For Cement, an individual would remove deteriorating wooden expansion joints located in grooves between concrete slabs. The length of the wooden expansion joints would be measured to permit the user to purchase and install the proper length of replacement expansion joint. The user would then insert the expansion joint of the present invention with the arrow side facing toward the ground into the groove from the wooden expansion joint. The newly installed expansion joint would be much more resistant to the weather elements than the wooden expansion joints. The triangular end would allow the expansion joints of the present invention easily to bore into the ground and the lips of the expansion joint of the present invention would keep the expansion joint in place.

9 Claims, 1 Drawing Sheet

(56) References Cited

U.S. PATENT DOCUMENTS

| | | | | | |
|---|---|---|---|---|---|
| 4,008,974 | A | * | 2/1977 | Miers | 404/48 |
| 4,067,155 | A | * | 1/1978 | Ruff et al. | 52/105 |
| 4,090,800 | A | * | 5/1978 | Koch | 404/48 |
| 4,128,358 | A | * | 12/1978 | Compton | 404/47 |
| 4,141,189 | A | * | 2/1979 | Borjeson | 52/396.06 |
| 4,198,176 | A | | 4/1980 | Bentz | |
| 4,329,080 | A | * | 5/1982 | Elley | 404/74 |
| 4,362,427 | A | * | 12/1982 | Mass et al. | 404/64 |
| 4,388,016 | A | * | 6/1983 | Levey | 404/48 |
| 4,516,876 | A | | 5/1985 | Wicks | |
| 4,548,009 | A | | 10/1985 | Dahowski | |
| 4,651,488 | A | * | 3/1987 | Nicholas et al. | 52/396.02 |
| 4,774,795 | A | * | 10/1988 | Braun | 52/396.07 |
| 4,889,445 | A | * | 12/1989 | Vittone | 404/64 |
| 4,906,129 | A | * | 3/1990 | Stegmeier | 404/64 |
| 4,979,846 | A | * | 12/1990 | Hill et al. | 404/65 |
| 5,044,835 | A | | 9/1991 | Fukushima et al. | |
| 5,956,912 | A | * | 9/1999 | Carter et al. | 52/396.02 |
| 6,219,982 | B1 | * | 4/2001 | Eyring | 52/396.04 |
| 6,681,540 | B2 | * | 1/2004 | Richardson | 52/396.04 |
| 6,751,919 | B2 | * | 6/2004 | Calixto | 52/573.1 |
| 6,893,187 | B2 | | 5/2005 | Lehto et al. | |
| 6,991,400 | B1 | * | 1/2006 | Negueloua | 404/56 |
| 2002/0088192 | A1 | * | 7/2002 | Calixto | 52/396.04 |

* cited by examiner

REPLACEMENT EXPANSION JOINT FOR CEMENT

CROSS REFERENCE TO RELATED APPLICATIONS

This U.S. Non-Provisional Patent Application claims priority to U.S. Provisional Patent Application No. 60/860,767 entitled "Replacement Expansion Joint For Cement" filed on Nov. 22, 2006.

FIELD OF THE DISCLOSURE

The disclosures made herein relate generally to the concrete accessories industry. The invention discussed herein is in the general classification of expansion joints for cement and concrete.

BACKGROUND

Concrete slabs are often poured directly on top of leveled soil or on top of a thermal insulator layer on the ground for a variety of building projects. Shrinkage of the concrete as well as thermal contraction and expansion often cause cracking in large slabs. The cracks that develop are aesthetically unpleasing and can also lead to safety concerns. Cracks may also allow substantial amounts of water leakage, causing property damage.

To combat cracking, large slabs of concrete often are divided into smaller sub-slabs by means of expansion joints. Most expansion joints are simply rectangular objects situated between the slabs of concrete. The deformation throughout the concrete that typically occurs will instead occur at the expansion joints and the concrete slabs will remain relatively crackless.

A variety of different types of expansion joints are available, requiring a variety of different types of installation methods. An expansion joint may be pressed into the fluid concrete after it has been poured and spread, but prior to it curing. Other times, grooves are cut on the surface of the slab by means of a saw.

Some expansion joints are embedded into concrete with metal reinforcements at the edges. The joint between the flat steel bars is cut open once the concrete has hardened and then filled with elastic material. However, this type of expansion joint requires a tedious and difficult installation process.

Wood bars are also often used to create an expansion joint. While the wood joints are initially attractive, they expand by absorbing water from the wet concrete and then contract as they dry. This process leaves a void space where the wood abuts the concrete at its side surfaces, allowing water to seep into the space to erode the joint. When these joints deteriorate, they become less aesthetically pleasing and need to be replaced. They also often come loose, leaving no expansion joint between adjacent slabs of concrete.

Hence, there is a need in the art for a convenient to use, inexpensive, durable, safe, effective, flexible and stationary expansion joint for use with concrete to replace existing expansion joints.

SUMMARY OF THE DISCLOSURE

Replacement Expansion Joint for Cement is an expansion joint for use with concrete.

The preferred embodiment of the invention utilizes an arrow shaped expansion joint made of PVC plastic with two holes bored inside the expansion joint.

The principal object of this invention is to provide a device to create a buffer zone between concrete slabs to permit contraction and expansion.

Another object of this invention is to provide a device to replace traditional wooden expansion joints between concrete slabs.

Another object of this invention is to provide an affordable device to replace traditional wooden expansion joints between concrete slabs.

Another object of this invention is to provide a safe device to replace traditional wooden expansion joints between concrete slabs.

Another object of this invention is to provide an aesthetically pleasing device to replace traditional wooden expansion joints between concrete slabs.

Another object of this invention is to provide a device that is easily inserted into concrete.

Another object of this invention is to provide a device that remains in place once it is inserted into concrete.

Yet another object of this invention is to provide a durable device that will not deteriorate over time to replace traditional wooden expansion joints between concrete slabs.

DETAILED DESCRIPTION OF THE DRAWINGS

The preferred embodiment of Replacement Expansion Joint for Cement is comprised of at least some of the following: an expansion joint made of PVC plastic and shaped like an arrow with two holes bored through it.

Figure 1:
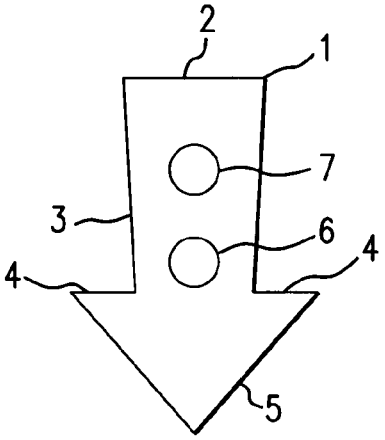
FIG. 1 depicts a frontal view of the preferred embodiment of the present invention.

FIG. 1 depicts a frontal view of the preferred embodiment of the present invention. An expansion joint 1 is approximately shaped like an arrow. The expansion joint 1 is made of flexible PVC plastic in this preferred embodiment. Though other materials could be utilized, the flexible PVC plastic allows the expansion joint 1 to expand or contract as needed and prevents the expansion joint 1 from absorbing water. The flexible PVC plastic design also prevents the expansion joint 1 from deteriorating over time like wooden expansion joints. The top 2 of the expansion joint 1 is one inch wide and the height of the expansion joint 1 is two and a quarter inches in this preferred embodiment. The length of the expansion joint 1 will vary and can be cut to appropriate length to accommodate a variety of concrete slabs lengths.

The opposing sides 3 of the expansion joint 1 transition into lips 4 toward the bottom of the expansion joint 1 that help form a triangular end 5 to the expansion joint 1. The opposing sides 3 of the expansion joint 1 taper inward from the top to the lips 4. The triangular end 5 allows the expansion joint 1 to be easily inserted into soil, wet concrete or other materials and firmly be secured into place. The triangular end 5 is one inch in height in this preferred embodiment. The lips 4 extend one quarter of an inch from the opposing sides 3. The lips 4 are located one and a quarter inches beneath the top 2 of the expansion joint 1. The lips 4 help keep the expansion joint 1 in place beneath the ground or concrete after installation.

A first hole 6 and a second hole 7 are bored throughout the length of the expansion joint 1. The first hole 6 is circular and cut just above the lips 4 and in the center of the expansion joint 1. The second hole 7 is also circular and located one quarter of an inch above the first hole 6. The first hole 6 and the second hole 7 are eight millimeters in diameter. The first hole 6 and the second hole 7 provide additional flexibility for the expansion joint 1 and additional areas for the joint to flex internally.

Figure 2:
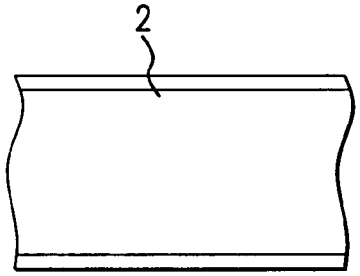
FIG. 2 depicts a top view of the preferred embodiment of the present invention.

FIG. 2 depicts a top view of the preferred embodiment of the present invention. Only the top 2 of the expansion joint is visible from this perspective.

Figure 3:
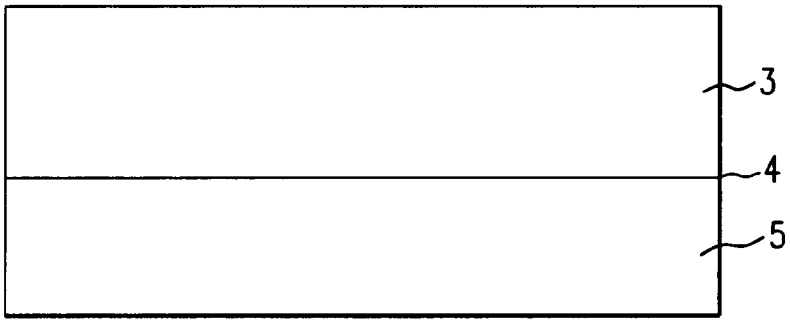
FIG. 3 depicts a side view of the preferred embodiment of the present invention.

FIG. 3 depicts a side view of the preferred embodiment of the present invention. The triangular end 5, one of the lips 4 and one of the opposing sides 3 of the expansion joint are visible from this view.

Figure 4:
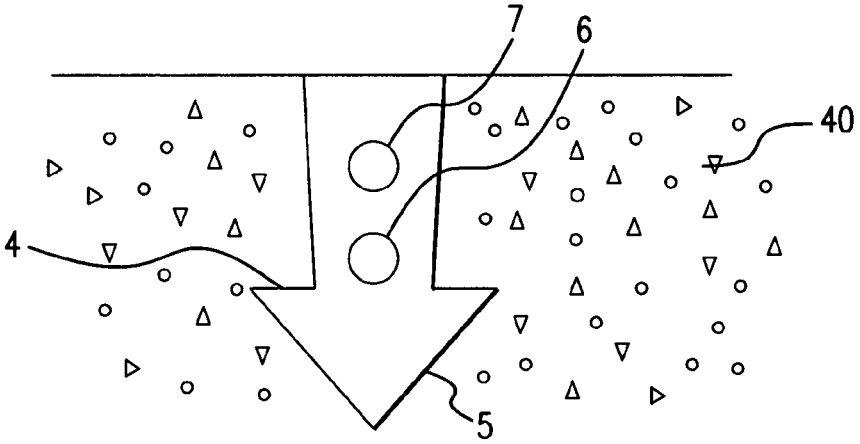
FIG. 4 depicts a frontal view of the preferred embodiment of the present invention installed in cement.

FIG. 4 depicts a frontal view of the preferred embodiment of the present invention installed in cement. The lips 4, triangular end 5, first hole 6 and second hole 7 are readily seen. The expansion joint is shown already inserted into cement 40 in this figure.

To use the preferred embodiment of Replacement Expansion Joint For Cement, an individual would remove deteriorating wooden expansion joints located in grooves between concrete slabs. The length of the wooden expansion joints would be measured to permit the user to purchase and install the proper length of replacement expansion joint. The user would then insert the expansion joint of the present invention with the arrow side facing toward the ground into the groove from the wooden expansion joint. The newly installed expansion joint would be much more resistant to the weather elements than the wooden expansion joints. The triangular end would allow the expansion joints of the present invention easily to bore into the ground and the lips of the expansion joint of the present invention would keep the expansion joint in place.

Replacement Expansion Joint for Cement could also be used during the installation of new expansion joints between concrete slabs. A user could install the device in a similar manner to the installation of traditional wooden expansion joints.

The materials utilized for Replacement Expansion Joint For Cement may vary widely but will likely include plastic components.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Replacement Expansion Joint For Cement can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold. In the preferred embodiment, the expansion joint will be made from PVC plastic and formed by extrusion molding.

It should be obvious that the components of the present invention can be of various shapes and sizes. It should also be obvious that the components of the invention can be made of different types of plastics or other suitable materials and can be of any color. Waterproof or water resistant materials would be best suited for application of the present invention. The expansion joint of the present invention could also have a single hole or hollow interior as opposed to two holes bored through the center as in the preferred embodiment.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A method of installing an expansion joint comprising:

measuring the length of the expansion joint groove;

cutting a length of new expansion joint based upon the measured length, the expansion joint being comprised of an elongated expansion joint body formed from a flexible material having a transverse cross section configured with opposite sidewalls that extend downward from a top of the expansion joint body, the top of the expansion joint body having no recess or cavity formed therein along the length of the expansion joint body, the lower end of the expansion joint body having a transverse cross section that is configured as a triangle, and wherein a pair of opposite projecting lips emanate from each of the sidewalls at the upper end of the triangle; and positioning the length of expansion joint within the expansion joint groove; and optionally removing any old preexisting expansion joint material of an expansion joint groove between two previously installed and hardened concrete slab sections prior to positioning the length of expansion joint within the expansion joint groove.

2. The method of 1, wherein:

the upper end of the triangle forms the pair of opposite projecting lips.

3. The method of 1, wherein:

the top of the expansion joint body is generally flush along the length of the expansion joint body.

4. The method of 1, wherein:

the opposite sidewalls of the expansion joint body taper inward from the top to the projecting lips of the triangle forming the lower end of the expansion joint body.

5. The method of 1, wherein:

the expansion joint has only a single pair of projecting lips.

6. The method of 1, wherein:

at least one centered hole extends through the length of the expansion joint body.

7. The method of 6, wherein:

there are only two centered holes that extend through the length of the expansion joint body, the holes being oriented one above the other.

8. The method of 6, wherein:

there is only a single centered hole that extends through the length of the expansion joint body.

9. The method of 1, wherein:

the upper surface of each of the projecting lips are generally perpendicular to a vertical axis of the expansion joint body.

* * * * *